US005822648A

United States Patent [19]

Mohri

[11] Patent Number: 5,822,648

[45] Date of Patent: Oct. 13, 1998

[54] TRANSFER DEVICE CLEANING SEQUENCE FOR AN IMAGE

[75] Inventor: Kazuo Mohri, Toyokawa, Japan

[73] Assignee: Minolta Co., Ltd., Osaka, Japan

[21] Appl. No.: 663,848

[22] Filed: Jun. 14, 1996

[30] Foreign Application Priority Data

Jun. 16, 1995 [JP] Japan ..... 7-150634

[51] Int. Cl.[6] ..... G06G 21/00

[52] U.S. Cl. ..... 399/46; 399/66; 399/302; 399/313

[56] References Cited

U.S. PATENT DOCUMENTS 5,196,893 3/1993 Nishise et al. .

FOREIGN PATENT DOCUMENTS 2-106763 4/1990 Japan .
4-296784 10/1992 Japan .
5-297739 11/1993 Japan .

*Primary Examiner*—Nestor R. Ramirez

[57] ABSTRACT

After the jam is cleared or after instruction of the start of printing, in order to remove the residual toner on an endless transfer belt or a secondary transfer roller, the endless transfer belt rotates in a state that the cleaner is contacted with the endless transfer belt and the secondary transfer roller is retracted from the endless transfer belt without applying the voltage by the voltage application means, and after one or more rotations of the endless transfer belt, the endless transfer belt continues to rotate in a state that the cleaner and the secondary transfer roller are contacted with the endless transfer belt with applying the voltage by the voltage application means.

18 Claims, 15 Drawing Sheets

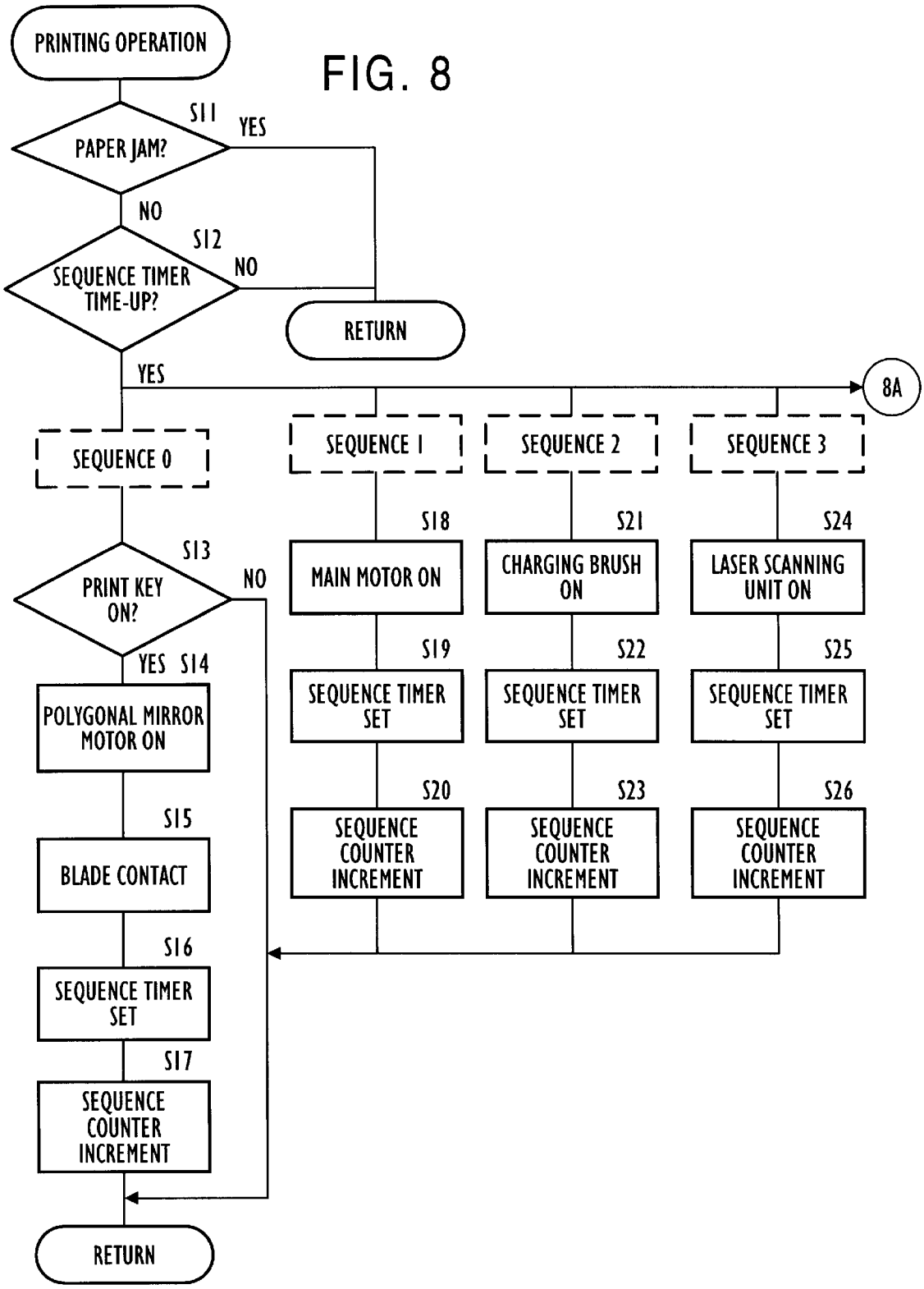
FIG. 8
PRINTING OPERATION
S11
PAPER JAM?
YES
NO
S12
SEQUENCE TIMER TIME-UP?
NO
RETURN
YES
8A
SEQUENCE 0
SEQUENCE 1
SEQUENCE 2
SEQUENCE 3
S13
PRINT KEY ON?
NO
YES S14
POLYGONAL MIRROR MOTOR ON
S15
BLADE CONTACT
S16
SEQUENCE TIMER SET
S17
SEQUENCE COUNTER INCREMENT
RETURN
S18
MAIN MOTOR ON
S19
SEQUENCE TIMER SET
S20
SEQUENCE COUNTER INCREMENT
S21
CHARGING BRUSH ON
S22
SEQUENCE TIMER SET
S23
SEQUENCE COUNTER INCREMENT
S24
LASER SCANNING UNIT ON
S25
SEQUENCE TIMER SET
S26
SEQUENCE COUNTER INCREMENT

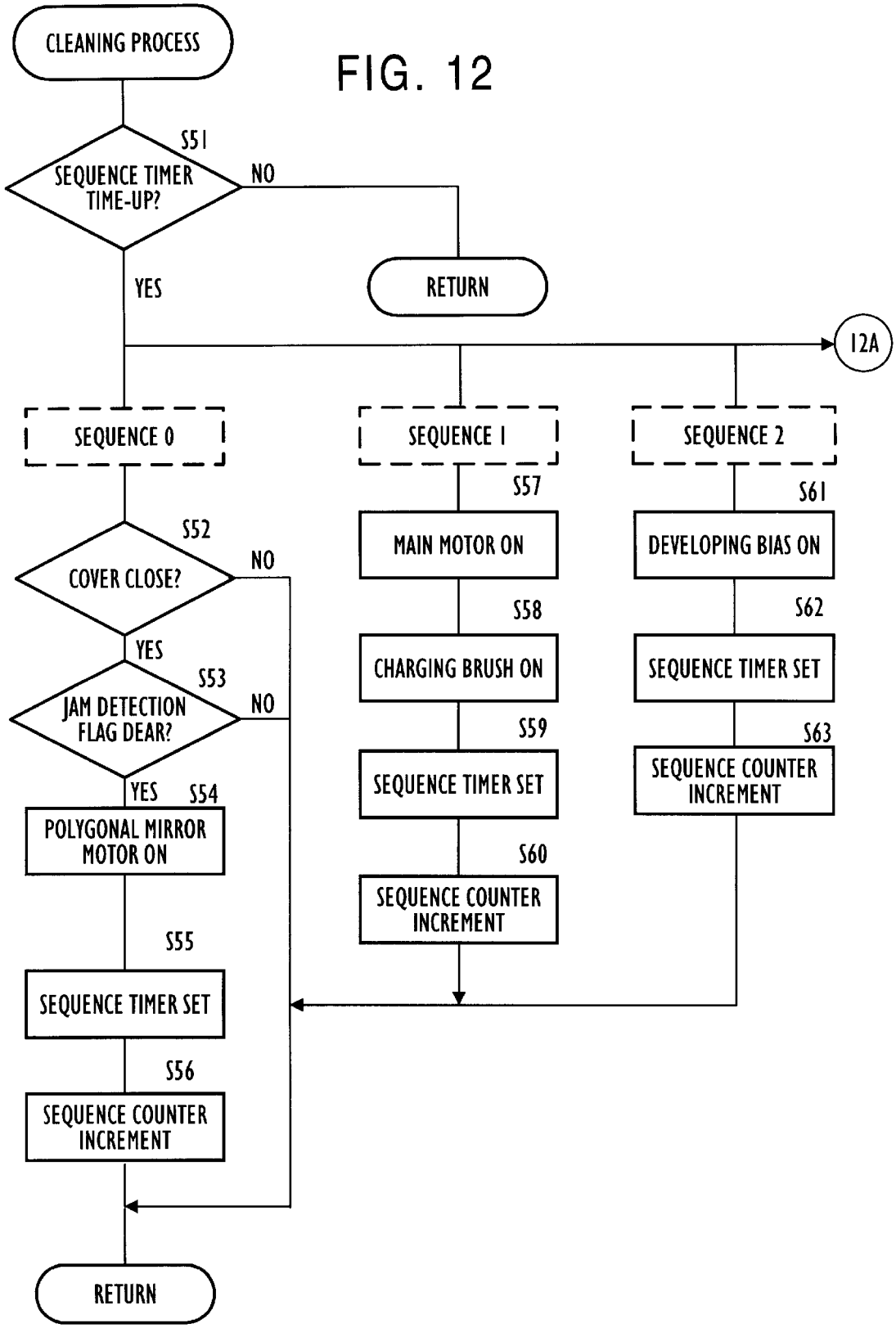
CLEANING PROCESS
FIG. 12
S51
SEQUENCE TIMER TIME-UP?
NO
RETURN
YES
12A
SEQUENCE 0
SEQUENCE 1
SEQUENCE 2
S52
COVER CLOSE?
NO
YES
S53
JAM DETECTION FLAG DEAR?
NO
YES
S54
POLYGONAL MIRROR MOTOR ON
S55
SEQUENCE TIMER SET
S56
SEQUENCE COUNTER INCREMENT
RETURN
S57
MAIN MOTOR ON
S58
CHARGING BRUSH ON
S59
SEQUENCE TIMER SET
S60
SEQUENCE COUNTER INCREMENT
S61
DEVELOPING BIAS ON
S62
SEQUENCE TIMER SET
S63
SEQUENCE COUNTER INCREMENT

TRANSFER DEVICE CLEANING SEQUENCE FOR AN IMAGE

BACKGROUND OF THE INVENTION

The present invention relates to an image forming apparatus for printers, copiers, facsimile machines and the like.

Conventional image forming apparatuses are known wherein, when a toner image developed on the surface of a photosensitive member is transferred to a recording sheet, the toner image is first transferred temporarily to an intermediate transfer member, and thereafter the toner image transferred to the intermediate transfer member is transferred to said recording sheet.

In the present invention, a primary transfer is defined as the transfer of a toner image from the surface of a photosensitive member to an intermediate transfer member, and a secondary transfer is defined as the transfer of a toner image from the intermediate transfer member to a recording sheet. Flexible shaped intermediate transfer belts are widely used as intermediate transfer members.

In image forming apparatuses provided with the aforesaid type of photosensitive member and intermediate transfer member, jamming of the recording sheet sometimes occurs in the recording sheet transport path. When a jam occurs, it is necessary to perform a cleaning process to remove residual toner from the surfaces of the photosensitive member and the intermediate transfer member so as to avoid adversely affecting the quality of subsequently printed images.

In the secondary transfer section which performs the secondary transfer, a secondary transfer roller is provided which is movable so as to contact with or retract from the intermediate transfer member. There is a possibility that when a jam occurs, toner may adhere to the secondary transfer roller.

Japanese Laid-Open Application No. HEI 5-297739 discloses cleaner blades (hereinafter referred to as "blade") provided to remove toner from the photosensitive member, the intermediate transfer belt, and secondary transfer roller via contact therewith.

In such conventional apparatuses, there are many parts provided due to the provision of blades for the photosensitive member, the intermediate transfer belt, and the secondary transfer roller, thereby increasing the cost of the apparatus.

Furthermore, if a blade is provided so as to normally contact with the intermediate transfer belt, the blade is subject to wear and deformation due to friction in conjunction with the rotation of the intermediate transfer belt, such that construction is desirable wherein the blade is contacted with the intermediate transfer belt only during cleaning and is retracted therefrom at other times.

Accordingly, a construction is required for accomplishing contact or retraction of the blades provided for each of the photosensitive member, intermediate transfer belt, and secondary transfer roller, thereby increasing the cost of the apparatus.

SUMMARY OF THE INVENTION

An object of the present invention is to eliminate the previously described disadvantages.

Another object of the present invention is to provide an image forming apparatus which reliably cleans residual toner from an intermediate transfer member and a secondary transfer member by controlling the contact and retraction of a cleaning blade and secondary transfer member so as to produce excellent images without soiling.

Still another object of the present invention is to provide an image forming apparatus which produces high quality images by cleaning an intermediate transfer member at the start of an image forming operation, and holding a cleaning blade position at a predetermined position during printing.

The present invention is directed to an image forming apparatus comprising: a photosensitive member which forms a toner image; an endless transfer belt which transfers said toner image from said photosensitive member; a driver which rotates said endless transfer belt; a secondary transfer roller which is provided so as to be capable of being in contact with said endless transfer belt or of retracting from said endless transfer belt, and which transfers said toner image from said endless transfer belt to a recording sheet fed between said endless transfer belt and said secondary transfer roller; a secondary transfer roller holder which holds said secondary transfer roller in a state of contact with said endless transfer belt or in a state of retracting from said endless transfer belt; a cleaner which is provided so as to be capable of being in contact with said endless transfer belt or retracting from said endless transfer belt, and which removes residual toner from said endless transfer belt in accordance with a rotation of said endless transfer belt in a state of contact with said endless transfer belt; a cleaner holder which holds said cleaner in a state of contact with said endless transfer belt or in a state of retracting from said endless transfer belt; a voltage application means for applying a voltage between said endless transfer belt and said secondary transfer roller so as to return residual toner remaining from said secondary transfer roller to said endless transfer belt; and a controller which controls said driver, said secondary transfer roller holder, said cleaner holder and said voltage application means in order to remove said residual toner on said endless transfer belt, so that said endless transfer belt rotates in a state that said cleaner is contacted with said endless transfer belt and said secondary transfer roller is retracted from said endless transfer belt without applying said voltage by said voltage application means, and after one or more rotations of said endless transfer belt, said endless transfer belt continues to rotate in a state that said cleaner and said secondary transfer roller are contacted with said endless transfer belt with applying said voltage by said voltage application means.

The secondary transfer roller may be rotated one or more rotations while applying said voltage using said voltage application means after one or more rotations of said endless transfer belt.

The image forming apparatus may be further provided with a jam detector which detects paper jam in a recording sheet feed path.

The image forming apparatus may be further provided with a jam removal detector which detects the elimination of said paper jam.

The controller may be operated after said jam removal detector detects the elimination of said paper jam.

The image forming apparatus may be further provided with an instruction means for instructing the start of a printing operation.

The controller may be operated after said instruction means instructs the start of said printing operation.

Therefore, the aforesaid construction is capable of effectively cleaning residual toner from the endless transfer belt and secondary transfer member, thereby improving image quality without toner-induced soiling such as fogging and streaking.

Also, the present invention is directed to an image forming apparatus comprising: a photosensitive member which forms a toner image; an intermediate transfer member which receives said toner image from said photosensitive member in accordance with a rotation of said intermediate transfer member; a secondary transfer member which is provided so as to be capable of contact or non-contact with said intermediate transfer member, and transfers said toner image on said intermediate transfer member to a recording sheet in a state of contact with said intermediate transfer member; a cleaner which removes residual toner on said intermediate transfer member in accordance with the rotation of said intermediate transfer member in a state of contact with said intermediate transfer member; a voltage application means for applying a voltage between said intermediate transfer member and said secondary transfer member so as to return residual toner remaining on said secondary transfer member to said intermediate transfer member; and a controller which operates said intermediate transfer member, said secondary transfer member and said voltage application means in order to remove said residual toner on said intermediate transfer member by said cleaner, so that said intermediate transfer member rotates in a state that said secondary transfer member is non-contacted with said intermediate transfer member without applying said voltage by said voltage application means, and after one or more rotations of said intermediate transfer member, said intermediate transfer member continues to rotate in a state that said secondary transfer member is contacted with said intermediate transfer member while applying said voltage using said voltage application means.

These and other objects, advantages and features of the invention will become apparent from the following description thereof taken in conjunction with the accompanying drawings which illustrate specific embodiment of the invention.

BRIEF DESCRIPTION OF THE DRAWINGS

In the following description, like parts are designated by like reference numbers throughout the several drawings.

FIG. 8 is a flow chart showing the sequence of the cleaning operation for the intermediate transfer belt at the start of the printing operation;

FIG. 12 is a flow chart showing the operating sequence of the cleaning process;

DETAILED DESCRIPTION OF THE PREFERRED EMBODIMENTS

The preferred embodiments of the present invention are described hereinafter with reference to the accompanying drawings.

Figure 1:
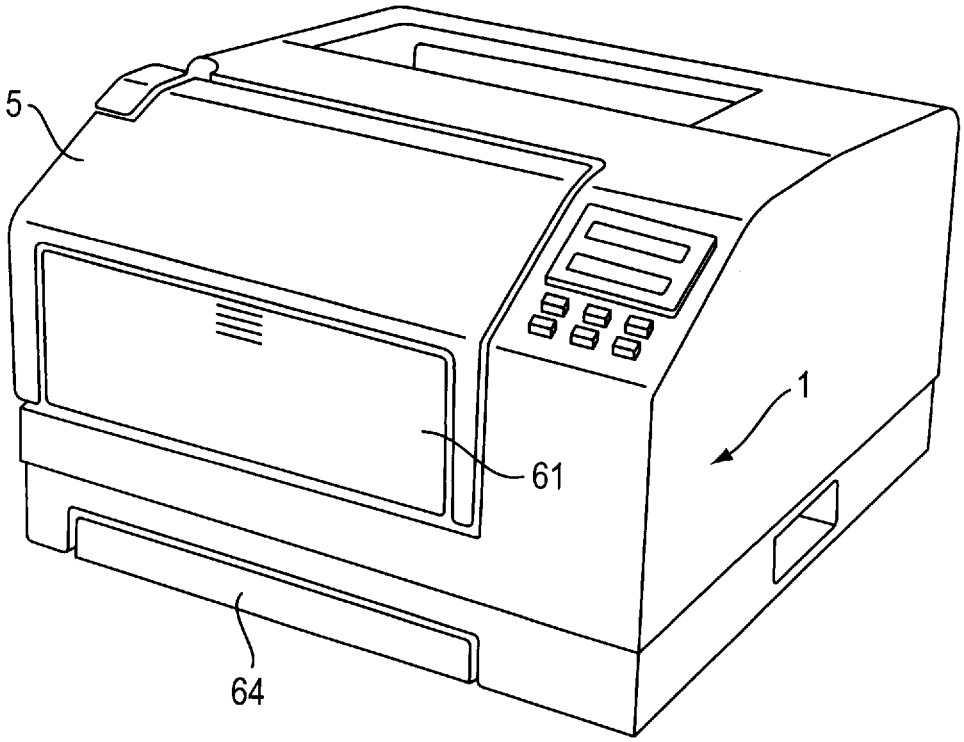
FIG. 1 is a perspective view viewed from the front showing a full color laser beam printer of an embodiment of the image forming apparatus of the present invention.
Figure 2:
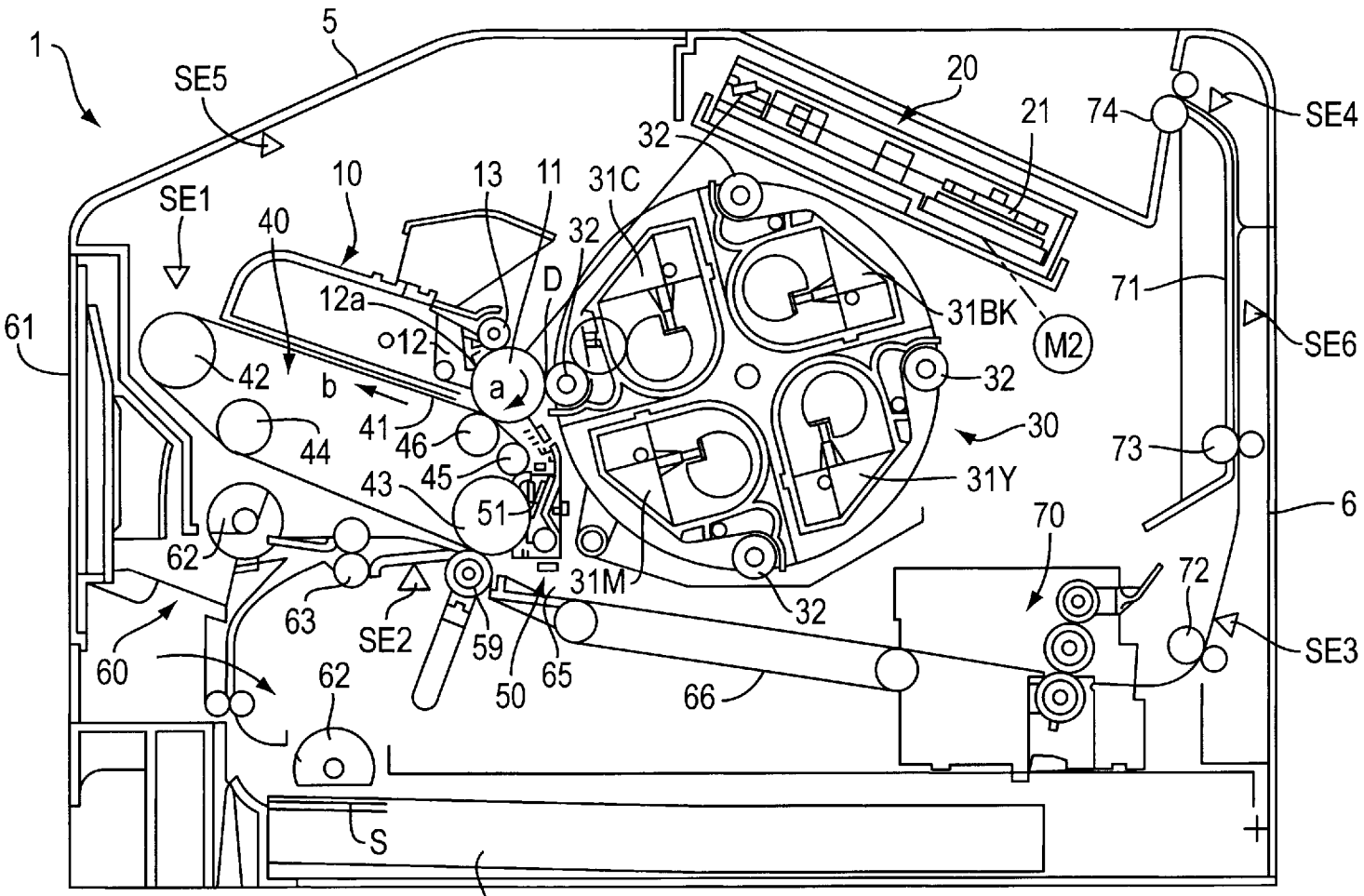
FIG. 2 briefly shows the internal construction of the full color laser beam printer.

FIG. 1 is a perspective view of a full color laser beam printer of an embodiment of the image forming apparatus of the present invention viewed from the front. FIG. 2 briefly shows the internal construction of the full color laser beam printer.

[General Construction of Printer]

As shown in FIG. 2, this printer briefly comprises a photosensitive member unit 10 provided with photosensitive drum 11 which is driven in rotation in the arrow a direction, laser scanning unit 20, developing unit 30, and intermediate transfer unit 40 provided with an intermediate transfer belt 41 of an endless type which is driven in rotation in the arrow b direction, and paper supply unit 60.

Arranged around the periphery of the aforesaid photosensitive drum 11 are a charging brush 13, and cleaner 12. Charging brush 13 uniformly charges the surface of the photosensitive drum 11. Cleaner 12 removes residual toner from the surface of photosensitive drum 11 via blade 12*a*.

Laser scanning unit 20 is a well known unit with built in laser diode, polygonal mirror 21, and fθ optical element; the control unit receives print data for cyan (C), magenta (M), yellow (Y), and black (Bk) from a host computer or like external device. Laser scanning unit 20 sequentially outputs print data for each color as laser beams which expose the surface of photosensitive drum 11. This scanning exposure sequentially forms electrostatic latent images for each color on the surface of photosensitive drum 11.

Developing unit 30 comprises four developing devices 31C, 31M, 31Y, and 31Bk accommodating developers containing C, M, Y, and Bk toners, respectively, which are integratedly mounted on a developing rack not shown in the drawing. This developing rack is rotatable in a clockwise direction about a support shaft. Each developing device is selectable via rotation such that the developing sleeve of a developing device corresponding to a electrostatic latent images of each color formed on the photosensitive drum 11 is brought to a developing position D. In the present embodiment, a rotary type developing unit 30 is used to allow a more compact design of the overall printer.

The intermediate transfer belt 41 of intermediate transfer unit 40 is an endless type belt looped around support rollers 42 and 43, and tension rollers 44 and 45, and driven in rotation in the arrow b direction in synchronization with the rotation of photosensitive drum 11 via a main motor M1. Photosensitive drum 11 is also driven in rotation by main motor M1. The edge portions outside the image region of intermediate transfer belt 41 is provided with a punctate portion used for alignment with the leading edge of a color image; and a belt position sensor SE1 is provided adjacent to intermediate transfer belt 41 to detect the belt position via detection of said punctate portion. A predetermined time after belt position sensor SE1 detects the aforesaid punctate portion, controls are executed to expose image data on the surface of photosensitive drum 11.

Intermediate transfer belt 41 is brought into contact with photosensitive drum 11 via pressure exerted by rotatable primary transfer roller 46, said region of contact being the primary transfer region. Intermediate transfer belt 41 confronts the horizontal feed path 65 of the recording sheet (described later) at the portion supported by support roller 43, and is in contact with rotatable secondary transfer roller 59. This contact region is the secondary transfer region.

Primary transfer roller 46 and secondary transfer roller 59 are provided with a well known voltage application means which supplies a bias voltage. The primary transfer roller 46 transfers the toner image on the surface of photosensitive drum 11 to intermediate transfer belt 41, and secondary transfer roller 59 transfers a toner image on intermediate transfer belt 41 to the recording sheet.

A cleaner 50 is provided in the space between the aforesaid developing unit 30 and intermediate transfer belt 41. Cleaner 50 has a cleaning blade 51 to scrape the residual toner from the surface of intermediate transfer belt 41. This cleaner 50 and secondary transfer roller 59 are capable of contact with and retraction from intermediate transfer belt 41.

Paper supply unit 60 comprises a manual feed tray 61 which opens on the front side (normal operator position) of printer body 1, paper cassette 64 removably installed in printer body 1 from the front side, feed roller 62, and timing roller 63. A recording sheet S accommodated in a stacked state in cassette 64 or a recording sheet stacked on manual feed tray 61 is fed one sheet at a time toward the right side of the drawing in FIG. 2 via the rotation of feed roller 62, and transported to the secondary transfer region in synchronization with the image formed on intermediate transfer belt 41 via timing roller 63. The horizontal transport path 65 of recording sheet S comprises an air absorption belt 66 or the like, and perpendicular transport path 71 from fixing device 70 is provided with transport rollers 72, 73, and 74. Recording sheet S is ejected from this perpendicular transport path 71 to the top of the printer body 1.

A plurality of recording sheet sensors SE2, SE3, and SE4 are provided within the recording sheet transport paths to detect the presence of recording sheet S. These recording sheet sensors SE2, SE3, and SE4 output detection signals, i.e., ON signals and OFF signals, when the leading edge and the trailing edge of recording sheet S is detected in the transport direction. A recording sheet S jam, i.e., a paper jam, as well as the jam location are detected based on the time intervals between detection signals output from the aforesaid recording sheet sensors SE2, SE3, and SE4.

When any of the recording sheet sensors SE2 through SE4 maintain an ON signal for more than a predetermined time, a jam is determined to have occurred. The operator is alerted to occurrence of this jam and the jam location by displaying a message on display panel 100 provided on the operation panel on the outside of the printer via a CPU described later.

In order to remove a jammed recording sheet S, the front cover 5 or back cover 6 of printer body 1 are opened and closed via hinged sections not shown in the drawings. When, for example, a jam occurs in the perpendicular transport path 71, an operator opens back cover 6 and removes the jammed recording sheet S. A front cover sensor SE5 and back cover sensor SE6 are provided adjacent to the front cover 5 and back cover 6, respectively, so as to detect when cover 5 and cover 6 are closed.

Front cover sensor SE5 and back cover sensor SE6 are ON when the respective covers are closed, and OFF when the respective covers are open.

Thus, when a jam is detected and a cover is opened, the sensor output changes from an ON signal to an OFF signal. When the jam is eliminated by an operator and the cover is closed, the sensor output changes from an OFF signal to an ON signal. The completion of the jam process is detected by means of the aforesaid change of the sensor output from an OFF signal to an ON signal.

[Full Color Printing Operation]

The full color printing operation of the present embodiment is described briefly below.

At the start of a printing operation, secondary transfer roller 59 is retracted from intermediate transfer belt 41. When the print operation starts, main motor M1 is actuated to rotate photosensitive drum 11 in the arrow a direction, and intermediate transfer belt 41 in the arrow b direction, and photosensitive drum 11 is charged to a predetermined potential by charging brush 13.

Then, a cyan image exposure is first accomplished via laser scanning unit 20, to form a cyan electrostatic latent image on the surface of photosensitive drum 11. This latent image is immediately developed by developing device 31C, and the toner image is transferred onto intermediate transfer belt 41 at the primary transfer region. Directly after the primary transfer ends, magenta image exposure is accomplished and the developing device 31M is switched to the developing position D to develop the latent image, then the developed toner image is transferred in a primary transfer. Thereafter, developing device 31Y is selected, and the yellow image is exposed and developed, and transferred in a primary transfer. Finally, developing device 31Bk is selected, the black image is exposed and developed, and transferred in a primary transfer, such that the aforesaid toner images are superimposed one over another on intermediate transfer belt 41.

When the final primary transfer is completed, developing unit 30 is switched to select developing device 31C in preparation for the next printing process, and secondary transfer roller 59 and blade 51 are simultaneously brought into contact with intermediate transfer belt 41. At this time, recording sheet S is transported to the secondary transfer region, and the full color toner image formed on the intermediate transfer belt 41 is transferred onto recording sheet S. When this secondary transfer is completed, secondary transfer roller 59 and blade 51 are retracted from intermediate transfer belt 41.

[Blade and Secondary Transfer Roller Contact/Retraction Mechanism for the Intermediate Transfer Belt]

Figure 3:
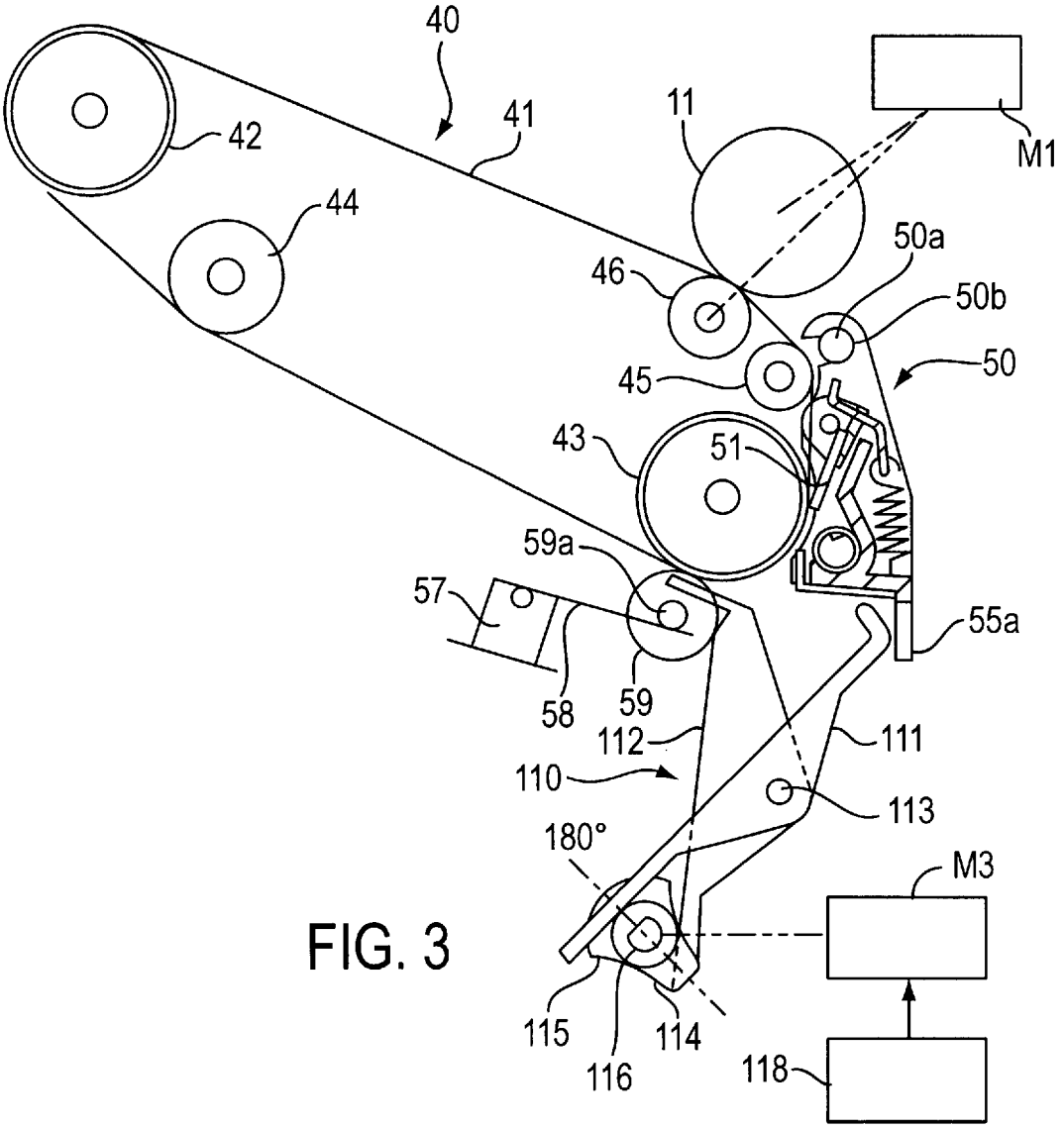
FIG. 3 shows the operating states of the contact/retraction mechanism; shown are the contact state of the cleaning blade and the contact state of the secondary transfer roller.
Figure 4:
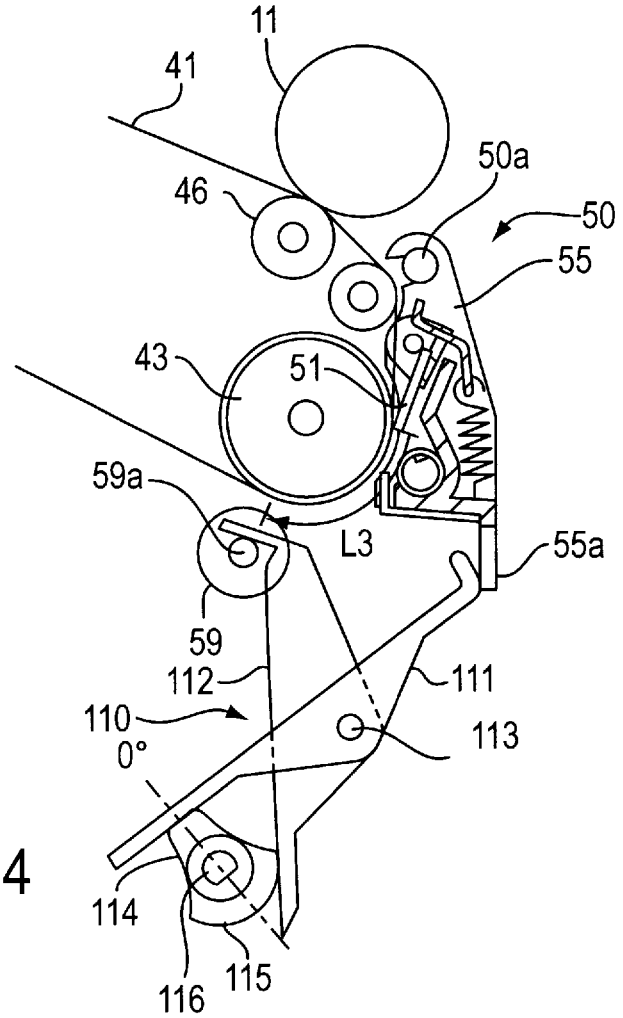
FIG. 4 shows the operating states of the contact/retraction mechanism; shown are the retracted state of the cleaning blade and the retracted state of the secondary transfer roller.

The blade 51 and secondary transfer roller 59 are retracted from intermediate transfer belt 41 during print standby (refer to FIG. 4). When a print operation command is issued, blade 51 is contacted with the surface of intermediate transfer belt 41 until the leading edge of a first color toner image reaches the front of the blade 51 position so as to clean intermediate transfer belt 41 without disturbing the first color toner image (refer to FIG. 5). Thereafter, blade 51 and secondary transfer roller 59 are retracted from intermediate transfer belt 41 until the toner images of four colors are superimposed one over another on intermediate transfer belt 41 (refer to FIG. 4). During the secondary transfer operation, blade 51 and secondary transfer roller 59 are contacted with the surface of intermediate transfer belt 41 (refer to FIG. 3).

When a paper jam occurs, however, and after said jam is cleared, blade 51 and secondary transfer roller 59 are moved from the retracted state from intermediate transfer belt 41 (refer to FIG. 4), and first only blade 51 is brought into contact with intermediate transfer belt 41 to scrape the toner therefrom (refer to FIG. 5), and thereafter, secondary transfer roller 59 is brought into contact with the surface of intermediate transfer belt 41 with a predetermined timing (refer to FIG. 3) to accomplish the cleaning of intermediate transfer belt 41 and secondary transfer roller 59.

Figure 5:
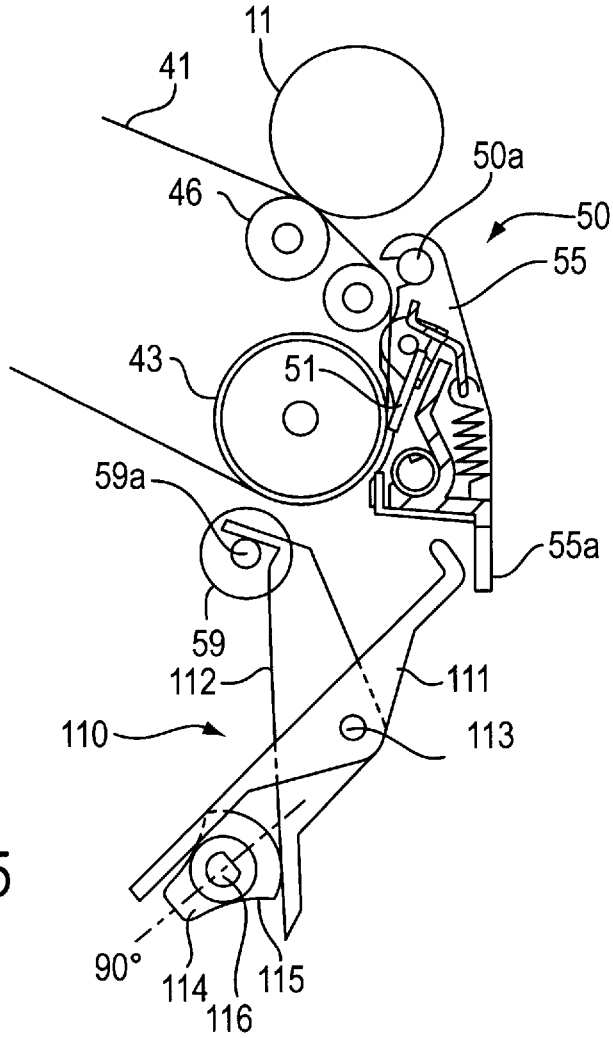
FIG. 5 shows the operating states of the contact/retraction mechanism; shown are the contact state of the cleaning blade and the retracted state of the secondary transfer roller.

Contact/retraction mechanism 110 controls the contact/retraction states of blade 51 and secondary transfer roller 59 as shown in FIGS. 3, 4, and 5. This contact/retraction mechanism 110 functions as a secondary transfer member holder for selectably holding secondary transfer roller 59 in a state of contact with or state of retraction from intermediate transfer belt 41, and functions as a cleaner blade holder for selectably holding blade 51 in a state of contact with or a state of retraction from intermediate transfer belt 41.

A first lever 111 and a second lever 112 of contact/retraction mechanism 110 are attached to shaft 113 so as to be rotatable, and a first cam 114 and a second cam 115 are fixedly mounted on a cam shaft 116. The tip of first lever 111 abuts a protrusion 55*a* of housing 55 of cleaner 50, and the angle of rotation is regulated by first cam 114. The tip of second lever 112 abuts shaft 59*a* of secondary transfer roller 59, and the angle of rotation is regulated by second cam 115. A cam driving motor M3 is connected to cam shaft 116 via a reduction mechanism not shown in the drawing and is capable of bidirectional forward and reverse rotation, and can driving motor M3 is controlled by CPU 118. The secondary transfer roller 59 is mounted on a holder 57 which is forced upward by a flat spring 58.

The first cam 114 and second cam 115 are normally positioned at an angle of rotation of 0°, as shown in FIG. 4. At this time, the tip of the first lever 111 abuts protrusion 55*a* of cleaner 50, so as to contact with housing 55 and cause blade 51 to retract from intermediate transfer belt 41. The tip of second lever 112 contacts with shaft 59*a*, so as to cause secondary transfer roller 59 to retract from intermediate transfer belt 41.

When cams 114 and 115 rotate 180°, the first lever 111 is rotated slightly in a counterclockwise direction and said tip retracts from protrusion 55*a*, as shown in FIG. 3. Thus, cleaner 50, which is rotatably engaged with pin 50*a* at concavity 50*b*, is slightly rotated in a clockwise direction about pin 50*a*, such that the tip of blade 51 is contacted with intermediate transfer belt 41. Second lever 112 is slightly rotated in a clockwise direction, such that the tip of said lever 112 retracts from shaft 59*a*. In this way, secondary transfer roller 59 is moved upward in the drawing by the force of flat spring 58 so as to be contacted with intermediate transfer belt 41. Levers 111 and 112, and cams 114 and 115 are set as shown in FIG. 3 when accomplishing the secondary transfer to recording sheet S after the four color toner images have been overlaid on intermediate transfer belt 41, and when cleaning secondary transfer roller 59 after clearing a paper jam.

When cams 114 and 115 are rotated 90° in a counterclockwise direction from the position of an angle of rotation of 0°, The first lever 111 is slightly rotated in a counterclockwise direction such that the tip of lever 111 is retracted from protrusion 55*a*, as shown in FIG. 5. Thus, cleaner 50 is rotated slightly in a clockwise direction about pin 50*a*, such that the tip of blade 51 is contacted with intermediate transfer belt 41. Second lever 112 is maintained in a posture identical to the posture maintained when the angle of rotation was 0°, and secondary transfer roller 59 is retracted from intermediate transfer belt 41. Levers 111 and 112 and cams 114 and 115 are set as shown in FIG. 5 when intermediate transfer belt 41 is cleaned before a printing operation starts, and when intermediate transfer belt 41 is cleaned after a paper jam is cleared.

This printer is capable of realizing auto image density control by automatically controlling the toner density by optically detecting a test pattern density. When accomplishing such control, a test pattern of each color toner is sequentially transferred to intermediate transfer belt 41 in a primary transfer, and while it is necessary to move toner by contacting blade 51 with intermediate transfer belt 41, toner soiling must be prevented by separating secondary transfer roller 59 from intermediate transfer belt 41. Therefore, even when accomplishing the aforesaid control, levers 111 and 112 and cams 114 and 115 are set as shown in FIG. 5.

[Control Unit]

Figure 6:
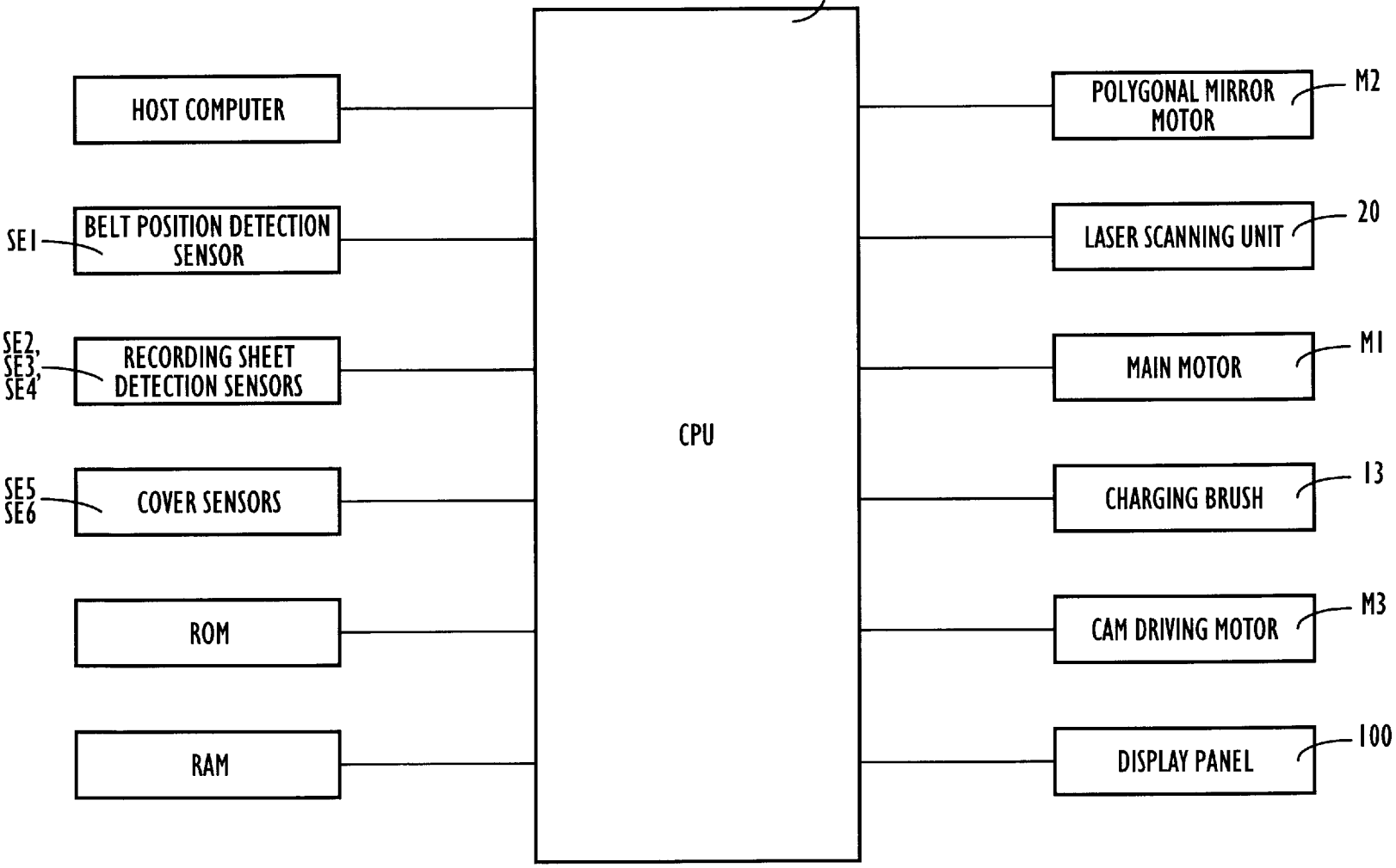
FIG. 6 is a brief block diagram of the full color laser beam printer control system.

FIG. 6 is a brief block diagram showing the printer control unit; a host computer is connected to CPU 118, and print signals and print data are input to CPU 118 from said host computer. Also connected to CPU 118 are belt position sensor SE1, recording sheet sensors SE2, SE3, and SE4, and cover sensors SE5 and SE6, which output belt position signals, sheet transport state signals, and cover open/closed condition signals to CPU 118.

On the other hand, control signals are output from CPU 118 to polygonal mirror motor M2 which rotates polygonal mirror 21 and main motor M1. Furthermore, control signals for accomplishing the charging process, exposure process, developing bias application process, and process of applying a primary transfer bias voltage relative to photosensitive drum 11 are output to charging brush 13, laser scanning unit 20, voltage application means and the like. Cleaner blade contact/retraction signals for controlling contact and retraction of blade 51 relative to intermediate transfer belt 41, and secondary transfer roller contact/retraction signals for controlling the contact and retraction of secondary transfer roller 59 relative to intermediate transfer belt 41 are output to cam driving motor M3. In addition, jam state signals and jam clear state signals are output from recording sheet sensors SE2 through SE4 and cover sensors SE5 and SE6 to display panel 100.

Memory means such as ROM or RAM or the like are connected to CPU 118, and the values of timer 1, timer 2, and timer 3 are stored beforehand in ROM. CPU 118 counts the values of each set timer.

[General Printer Operation]

Figure 7:
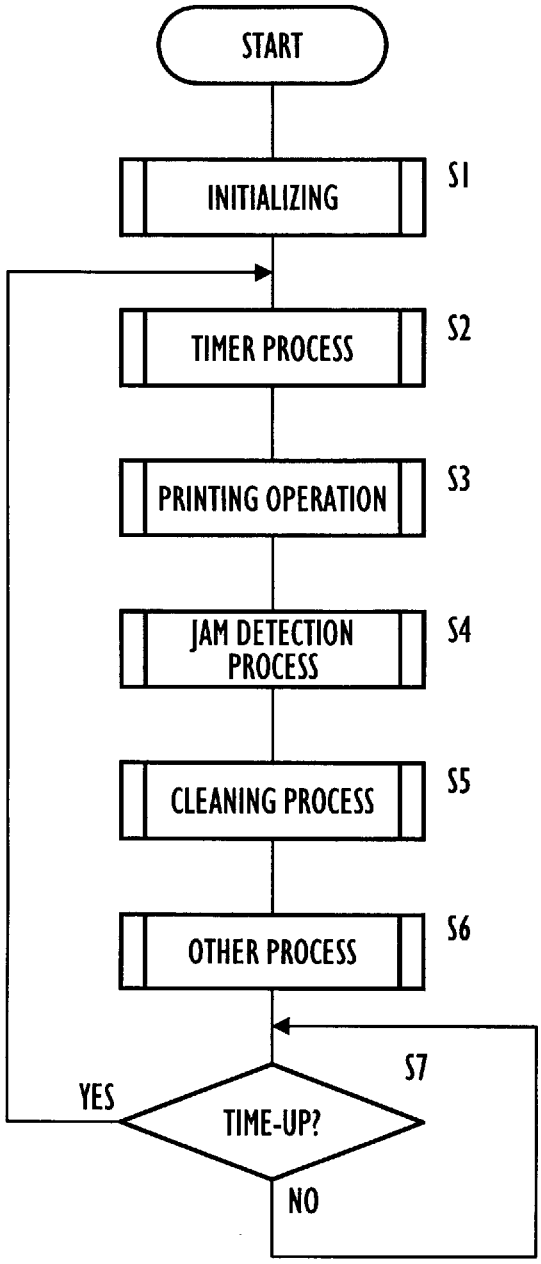
FIG. 7 is a main flow chart showing the sequence of the general operation of the printer of the present embodiment.

The sequence of general operation of the printer of the present embodiment is described below with reference to the main flow chart of FIG. 7.

When printer operation starts, the CPU initialization process is executed to initialize the sequence counter, various types of flags, timers, and variables (step S1). And after the timer process is executed to set the timing of various controls (step S2), the print start process is executed (step S3). The jam detection process is executed to detect whether or not a jam has occurred during the printing operation (step S4). When a jam occurs, the jam process is executed, and thereafter the cleaning process is executed to clean intermediate transfer belt 41 and secondary transfer roller 59 (step S5). Subsequently, after other processes are executed, e.g., the sheet discharge process, error process and the like (step S6), the standby process is executed (step S7), and the routine returns to step S2 and the aforesaid processes continue.

[Contact/Retraction Mechanism Operating Sequence]

The operating sequence of contact/retraction mechanism during the processes of steps S3 through S5 is described below.

The aforesaid controls are accomplished by controlling cam driving motor M3 via CPU 118.

When CPU 118 outputs blade retraction signals and secondary transfer roller retraction signals to cam driving motor M3, said motor M3 rotates first cam 114 and second cam 115 to the angle of rotation 0° position based on the aforesaid signals, as shown in FIG. 4. By means of the rotation of cams 114 and 115 to the aforesaid position, the tip of first lever 111 abuts protrusion 55*a* of cleaner 50, and blade 51 is retracted from intermediate transfer belt 41. On the other hand, the tip of second lever 112 contacts with shaft 59*a*, and secondary transfer roller 59 is retracted from intermediate transfer belt 41.

When CPU 118 outputs a blade contact signal and a secondary transfer roller retraction signal to cam driving motor M3, said motor M3 rotates first cam 114 and second cam 115 to the angle of rotation 90° position based on the aforesaid signals, as shown in FIG. 5. By means of the rotation of cams 114 and 115 to the aforesaid position, the tip of first lever 111 retracts from protrusion 55*a* of cleaner 50, and blade 51 contacts with intermediate transfer belt 41. On the other hand, the tip of second lever 112 contacts with shaft 59*a*, and secondary transfer roller 59 is retracted from intermediate transfer belt 41.

When CPU 118 outputs a blade contact signal and a secondary transfer roller contact with signal to cam driving motor M3, said motor M3 rotates first cam 114 and second cam 115 to the angle of rotation 180° position based on the aforesaid signals, as shown in FIG. 3. By means of the rotation of cams 114 and 115 to the aforesaid position, the tip of first lever 111 retracts from protrusion 55*a* of cleaner 50, and blade 51 contacts with intermediate transfer belt 41. On the other hand, the tip of second lever 112 retracts from shaft 59*a*, and secondary transfer roller 59 contacts with intermediate transfer belt 41.

[Print Start Process]

Figure 9:
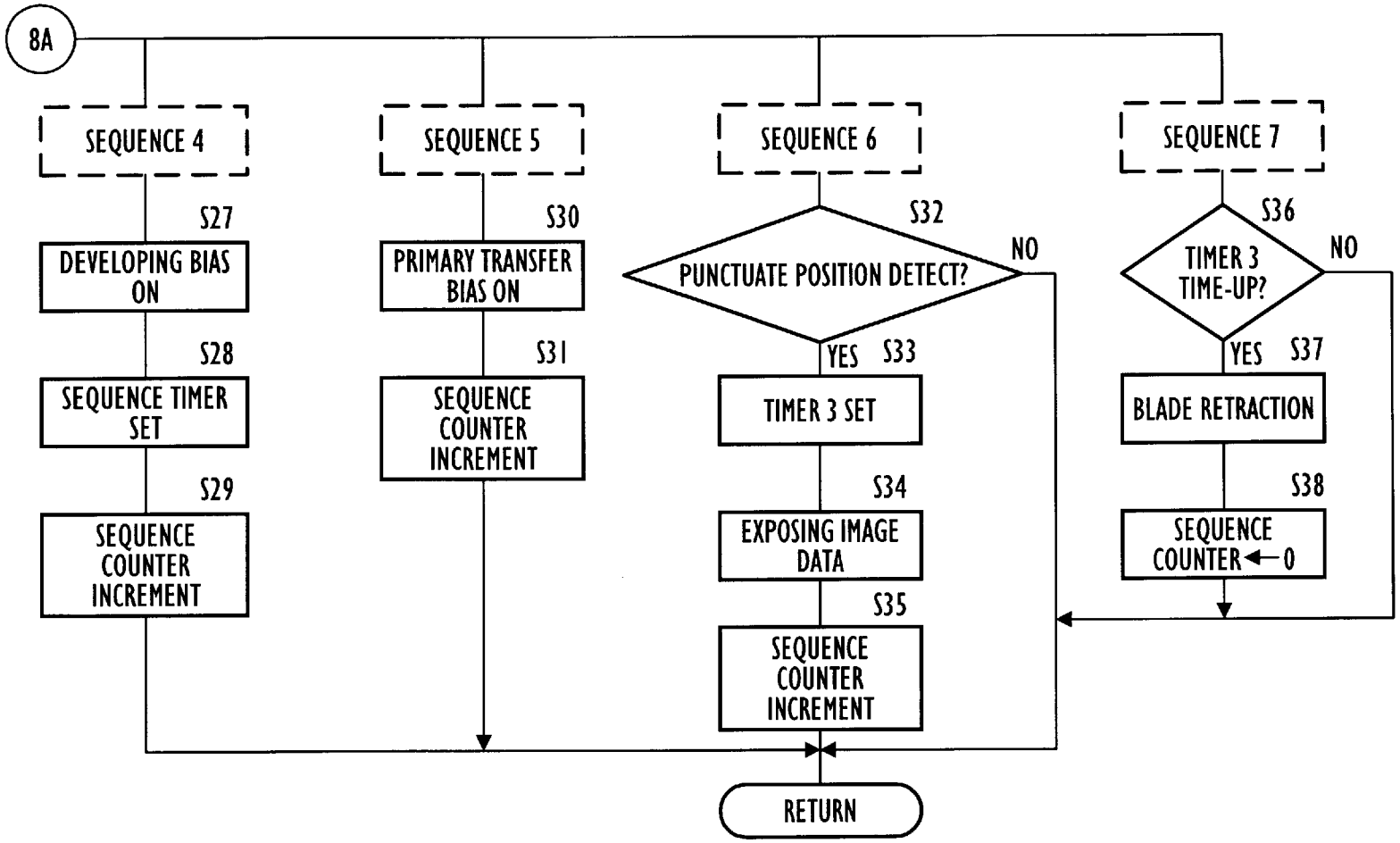
FIG. 9 shows a portion of FIG. 8, and is a flow chart showing the sequence of the cleaning operation of the intermediate transfer belt at the start of the printing operation.
Figure 10:
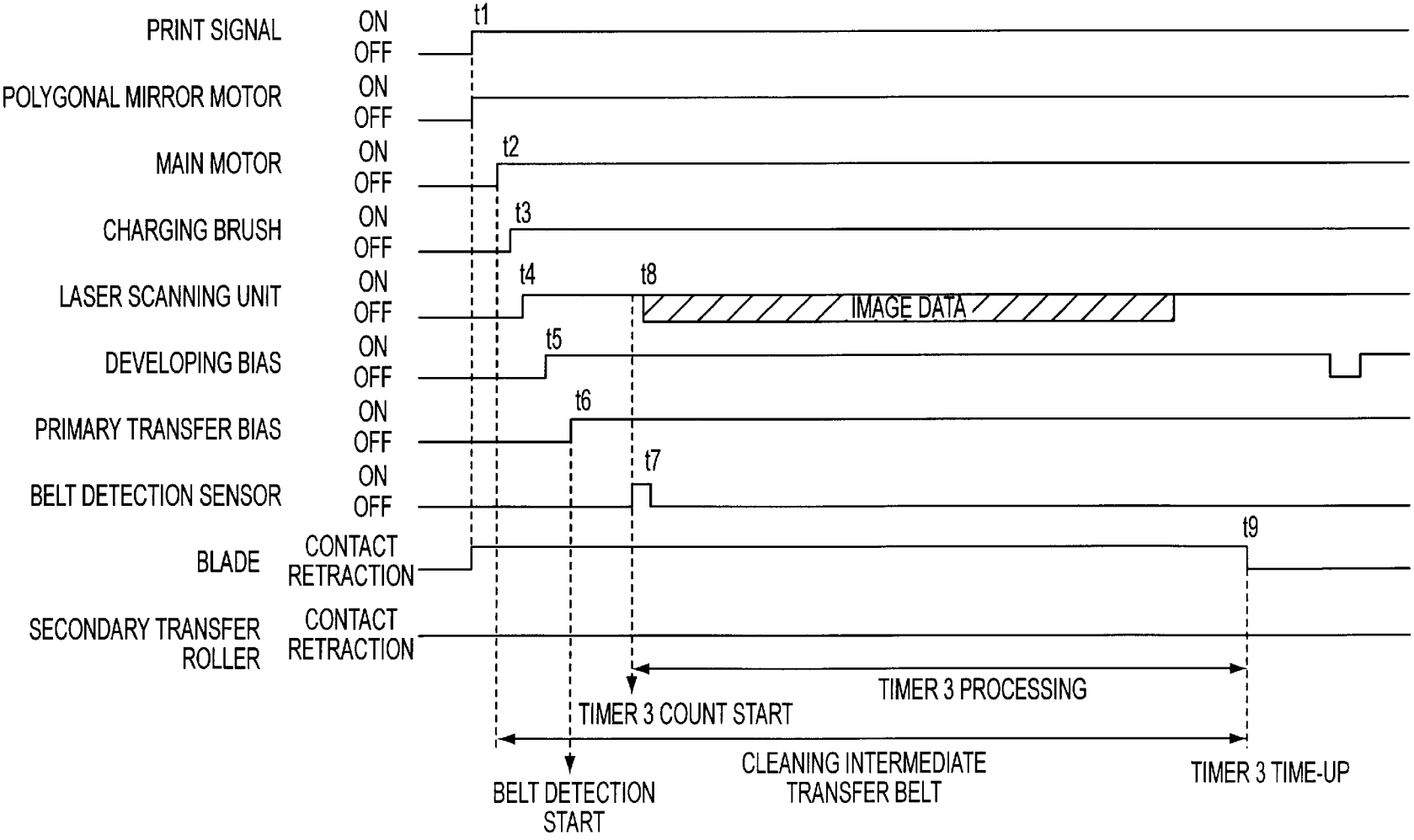
FIG. 10 is a sequence timing chart showing the sequence of the cleaning operation for the intermediate transfer belt at the start of the printing operation.

The cleaning operation sequence of intermediate transfer belt 41 in the print start process of step S3 is described below with reference to the flow charts of FIGS. 8 and 9 and the sequence timing chart of FIG. 10.

When the printer power unit is turned ON, CPU 118 always outputs a blade retraction signal and secondary transfer roller retraction signal to cam driving motor M3, so as to retract blade 51 and secondary transfer roller 59 from intermediate transfer belt 41. Thus, the retraction of blade 51 and secondary transfer roller 59 from intermediate transfer belt 41 prevents contact tracks from forming on intermediate transfer belt 41 and deformation of blade 51 and intermediate transfer belt 41 due to long-term contact of blade 51 and secondary transfer roller 59 with intermediate transfer belt 41.

Starting the printer begins with the process of sequence zero [0] because there is no paper jam (step S11), the sequence timer ends (step S12), and the sequence counter is set at zero [0]. That is, when CPU 118 recognizes an ON print signal received from an external device such as a host computer or the like (step S13), the print operation starts and polygonal mirror motor M2 is actuated (step S14). As shown at time t1 in the timing chart of FIG. 10, CPU 118 outputs a blade contact signal simultaneously with the actuation of polygonal mirror motor M2, and the leading edge of blade 51 is contacted with intermediate transfer belt 41, as shown in FIG. 5 (step S15). On the other hand, second lever 112 is maintained in a posture identical to the posture maintained when the angle of rotation is 0°, and secondary transfer roller 59 remains retracted from intermediate transfer belt 41.

Then, a predetermined value is set in the sequence timer (step S16), and after the sequence count is incremented by [1] (step S17), the routine returns to the main flow. The controls of steps S4 through S7 and step S2 in the main flow are executed, the print start routine of step S3 is executed again, and if the value of the sequence timer set in step S16 is incremented, the sequence counter is set at [1], and the process of sequence 1 is executed. Similarly, the setting of the sequence timer, incrementing of the sequence counter value one by one, and processes of sequence 1 through sequence 7 are executed.

In sequence 1 (steps S18 through S20), after blade 51 is contacted with intermediate transfer belt 41 for a uniform time (time t2 in the timing chart), the main motor M1 is actuated (S18), and photosensitive drum 11 is rotated, and intermediate transfer belt 41 is rotated at identical circumferential speeds. Thus, the residual toner remaining on the surface of intermediate transfer belt 41 is removed by blade 51 which is contacted with said intermediate transfer belt 41, and the cleaning of intermediate transfer belt 41 begins. The reason for the contact of blade 51 with intermediate transfer belt 41 before main motor M1 is actuated, i.e., before intermediate transfer belt 41 starts rotation, is to prolong, even slightly, the time available to clean the intermediate transfer belt 41.

In sequence 2 (steps S21 through S23), after a uniform time (time t3 in the timing chart) following actuation of motor M1, the charging process is executed (S21) to uniformly charge the surface of photosensitive drum 11 to a predetermined potential via charging brush 13.

In sequence 3 (steps S24 through S26), after a uniform time has elapsed following the charging of photosensitive drum 11 (time t4 in the timing chart), the exposure process is executed (S24) to expose the surface of photosensitive drum 11 via laser scanning unit 20.

In sequence 4 (steps S27 through S29), a uniform time following the start of exposure (time t5 in the timing chart), the developing bias process is executed (S27), and in sequence 5 (steps S30 and S31), after a uniform time following the execution of the developing bias process (time t6 in the timing chart), the primary transfer bias process is executed (S30), a bias voltage is supplied to primary transfer roller 46 by a primary transfer voltage application means to accomplish print preparation. The bias voltage applied to the primary transfer roller 46 is a voltage of the opposite polarity to the polarity of the toner charge.

A single punctate portion is provided on intermediate transfer belt 41 for alignment with the position of the leading edge of the color image. When belt position sensor SE1 detects the punctate portion (time t7 in the timing chart), and a predetermined time has elapsed (time t8 in the timing chart), image data are exposed on the surface of photosensitive drum 11 in step S34 (belt position detection).

After print preparation ends, in sequence 6 (steps S32 through S35), when CPU 118 starts belt position detection and belt position sensor SE1 detects the punctate portion of the belt (time t7 in the timing chart), the count of timer 3 starts to set the timing for the retraction of blade 51 (steps S32, S33). Timer 3 is set internally in CPU 118.

The timing by which blade 51 retracts from intermediate transfer belt 41 must be such as to not cause blade 51 to clean the toner image transferred to intermediate transfer belt 41 in the primary transfer. That is, blade 51 must be retracted from intermediate transfer belt 41 when the leading edge of an image of a first color of a color print reaches a position a predetermined measure α (mm) in front of the position of blade 51.

Thus, the timer value (T3) set in timer 3 is determined as follows.

T3 (seconds)={(distance from exposure position to blade position)−α}/V where α is the distance (mm) from the leading edge of a first color image that is not cleaned, and V is the system speed (mm/sec).

After the belt position is detected, the latent image of a first color of a color print exposed on photosensitive drum 11 is developed by developing unit 30, and the developed image is transferred to intermediate transfer belt 41 at the primary transfer region. Timer 3 ends when the leading edge of a first color toner image on intermediate transfer belt 41 reaches a position α (mm) of blade 51.

In sequence 7 (steps S36 through S38), when the count of timer 3 ends (time t9 in the timing chart), CPU 118 outputs a blade retraction signal to cam driving motor M3, and first cam 114 and second cam 115 are rotated to the position of angle of rotation 0°, as shown in FIG. 4, to retract blade 51 from intermediate transfer belt 41. If the sequence counter is set at zero [0], the cleaning operation ends for intermediate transfer belt 41 ends in the print start process.

Since blade 51 is held in the retracted state during print standby, contact tracks are prevented from forming on intermediate transfer belt 41 and deformation of intermediate transfer belt 41 and blade 51 itself are prevented so as to improve the quality of the printed image.

At the start of the printing operation, the intermediate transfer belt 41 is precleaned before the toner image is transferred from photosensitive drum 11 to intermediate transfer belt 41. Furthermore, the toner image transferred from photosensitive drum 11 to intermediate transfer belt 41 is not disturbed by blade 51 because said blade 51 is held in a retracted state with a predetermined timing. The cleaning area of intermediate transfer belt 41 can be markedly enlarged because blade 51 is held in a contact state before intermediate transfer belt 41 is used to carry an image. Accordingly, the quality of the printed image is improved because the intermediate transfer member is cleaned before the start of the print operation.

Thereafter, the toner images of the second color through the fourth color are sequentially overlaid on intermediate transfer belt 41, and transferred to recording sheet S.

[Jam Detection Process]

Figure 11:
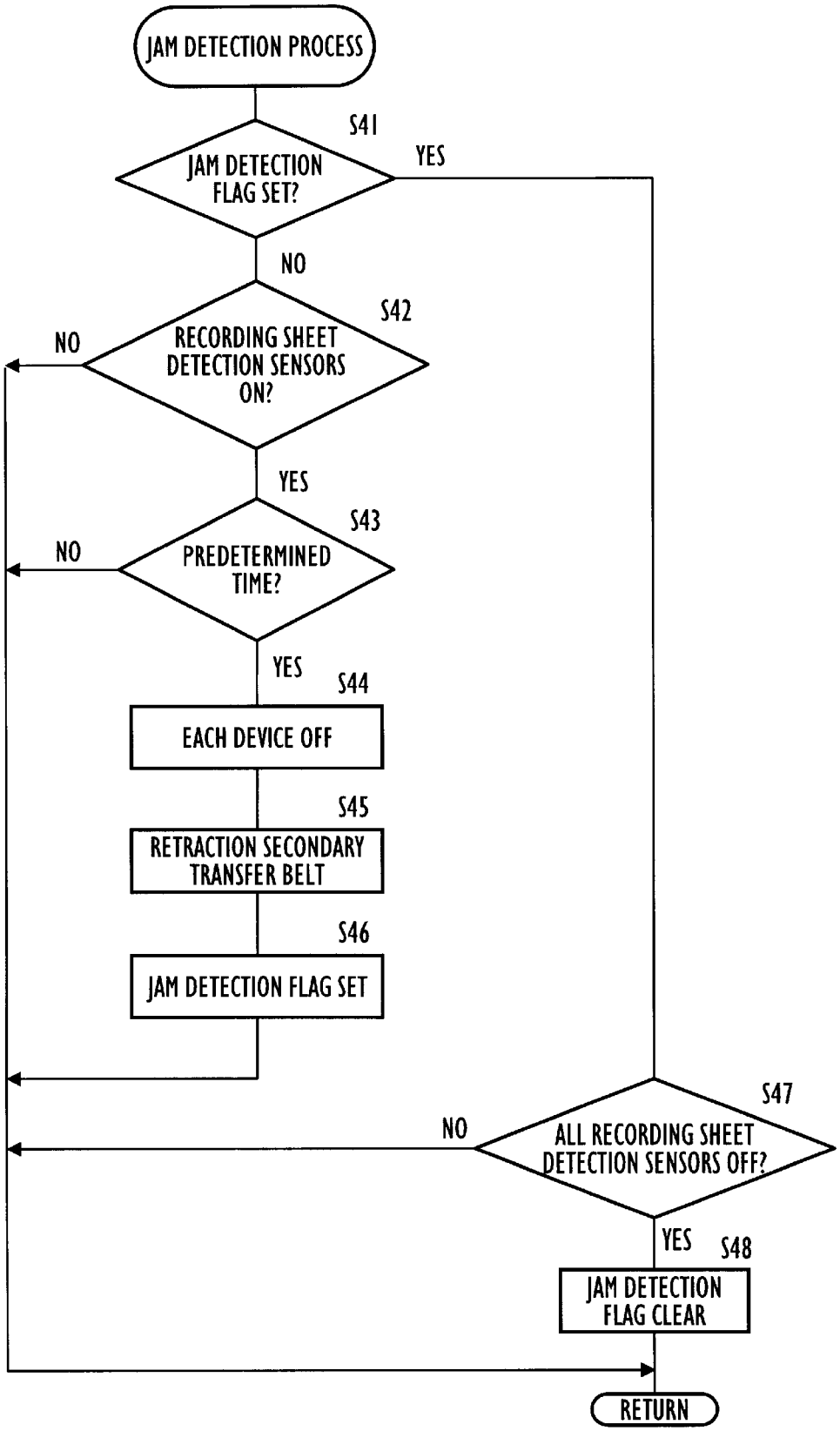
FIG. 11 is a flow chart showing the operating sequence of the jam detection process.

The operation sequence of the jam detection process of step S4 is described below with reference to the flow chart of FIG. 11.

CPU 118 determines a jam has occurred if a jam detection flag has not been set (S41), and a check of the states of recording sheet detection sensors SE2, SE3, and SE4 (S42) discloses that any one sensor among said sensors SE2, SE3, SE4 has been ON for more than a predetermined time (S43).

At this time, CPU 118 outputs control signals to turn off each device and stop the print process (S44), then outputs secondary transfer roller retraction signals to cam driving motor M3 to retract secondary transfer roller 59 from intermediate transfer belt 41 (S45). The retraction of secondary transfer roller 59 readily allows an operator to clear a jam, and prevents unnecessary adhesion of toner on secondary transfer roller 59 when cleaning intermediate transfer belt 41.

Then, the jam detection flag is set (S46), The jam detection flag is cleared by completely removing the jammed sheet remaining in the printer during the jam process to switch OFF all recording sheet detection sensors SE2, SE3, SE4 (steps S47, S48).

[Cleaning Process]

Figure 13:
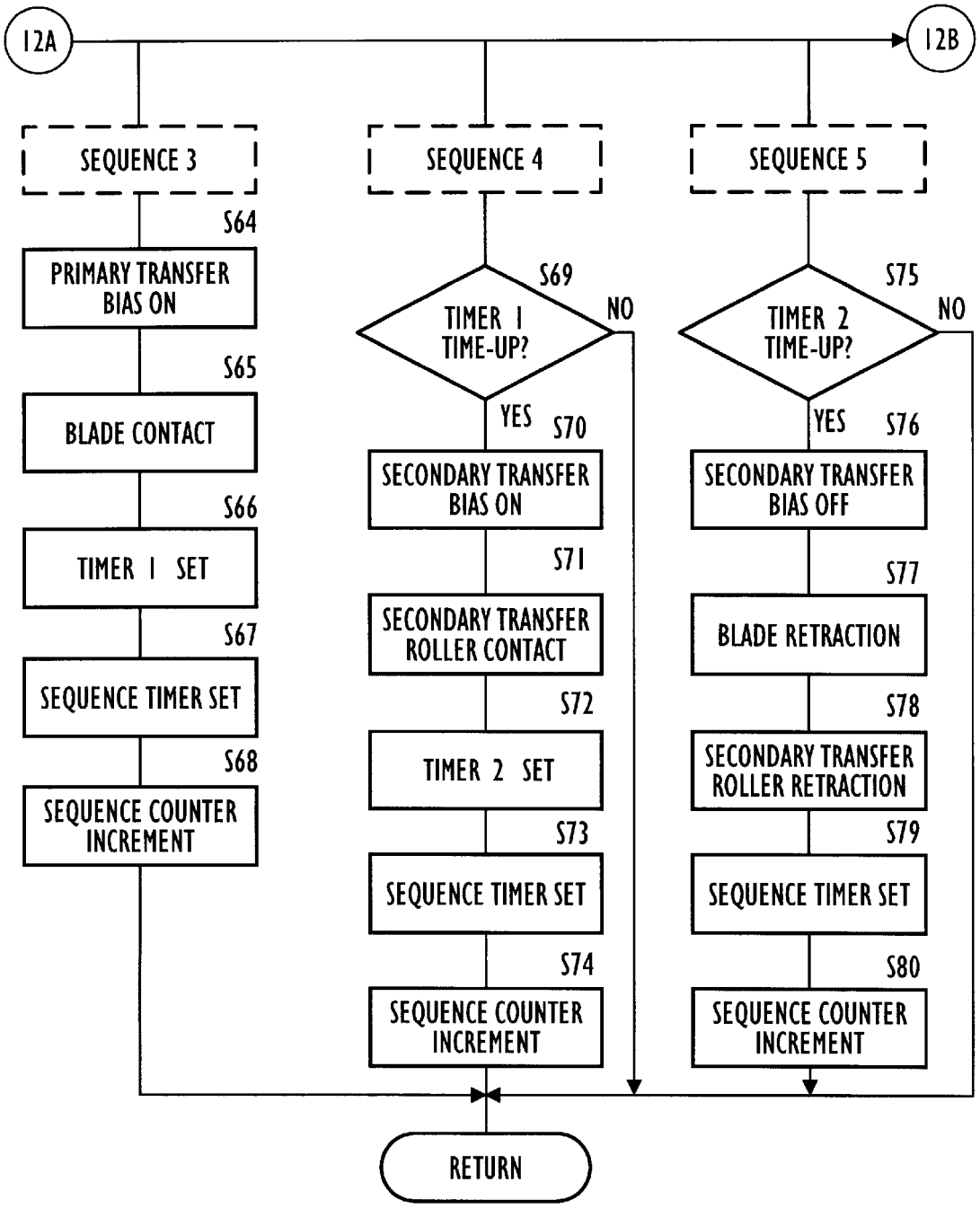
FIG. 13 is a part of FIG. 12, and is a flow chart showing the operating sequence of the cleaning process.
Figure 14:
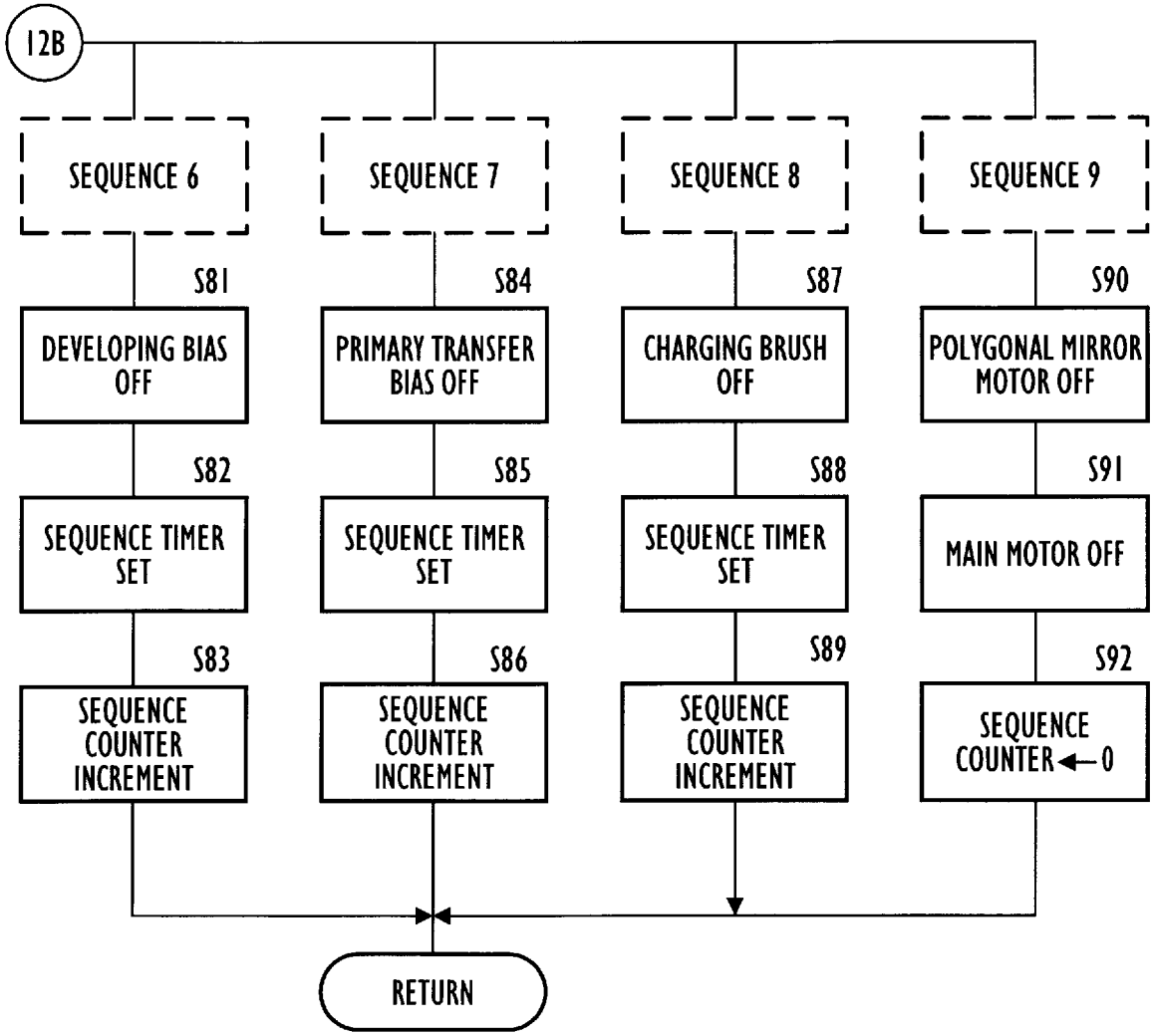
FIG. 14 is a part of FIG. 12, and is a flow chart showing the operating sequence of the cleaning process.
Figure 15:
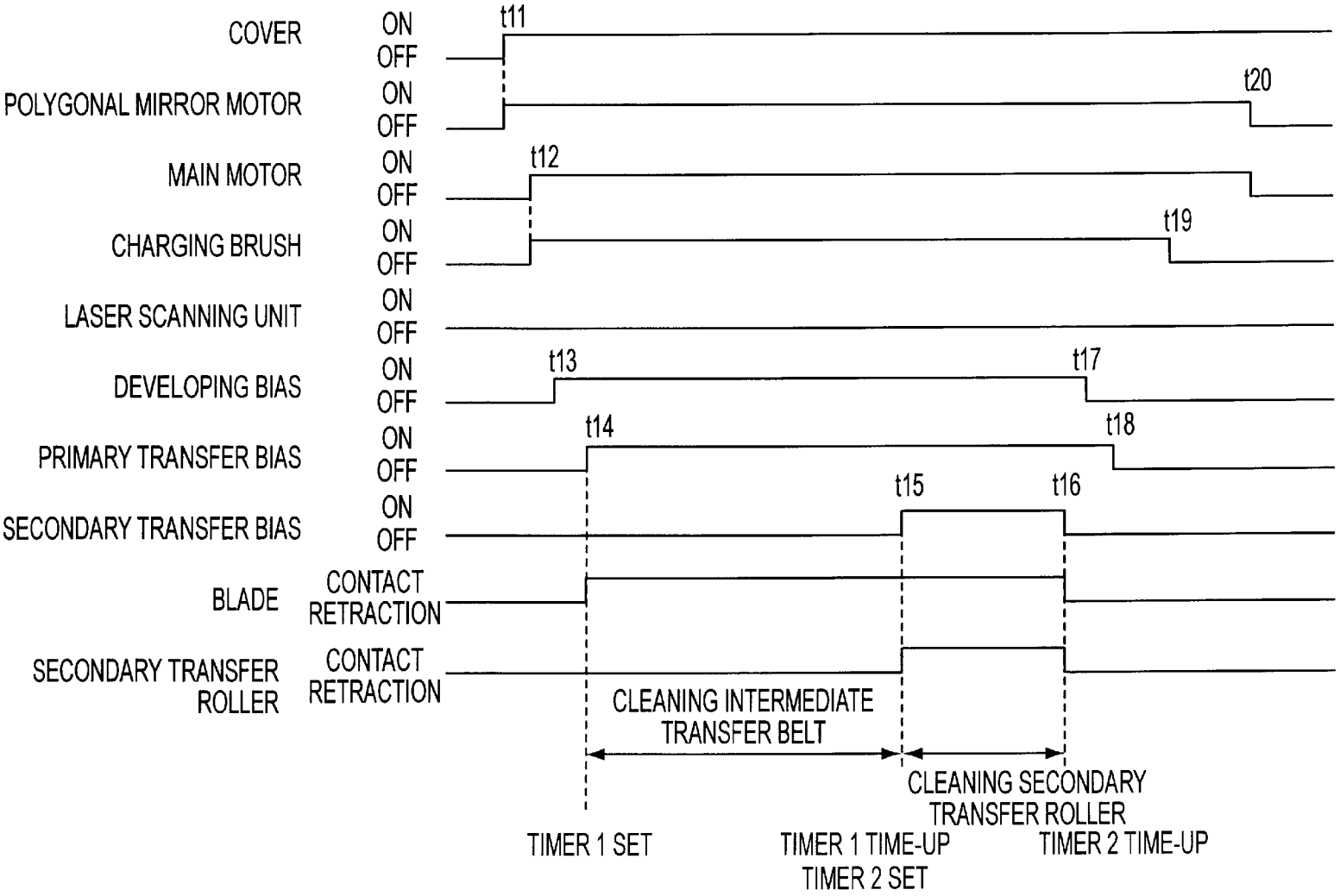
FIG. 15 is a sequence timing chart showing the operating sequence of the cleaning process.

The operation sequence of the cleaning process of step S5 is described below with reference to the flow charts of FIGS. 12 through 14, and the timing chart of FIG. 15.

Since the start of the cleaning process ends the sequence timer (S51) and sets the sequence counter at zero [0], the process of sequence 0 (zero) is executed. That is, CPU 118 determines whether or not the jam is cleared (steps S52, S53), and when the clearing of the jam is recognized, the cleaning process starts, and polygonal mirror motor M2 is actuated (step S54, time t11 in the timing chart of FIG. 15). Detection of the cleared jam is accomplished after the closing of the cover is verified by cover sensors SE5 and SE6, by verifying the jam detection flag has been cleared (S52, S53).

Then, a predetermined value is set in the sequence timer (S55), and after the sequence counter is incremented by [1] (S56), the routine returns to the main flow. The controls of steps S6, S7, and S2 through S4 are executed in the main flow, the cleaning process routine is again executed in step S5, and when it is determined that the value of the sequence timer set in step S55 has been incremented, a value of [1] set in the sequence counter, whereupon sequence 1 is executed. Similarly, the setting of the sequence timer, incrementing of the sequence counter value one by one, and processes of sequence 1 through sequence 9 are executed.

In sequence 1 (steps S57 through S60), after a predetermined time (time t12 in the timing chart) following actuation of polygonal mirror motor M2, main motor M1 is actuated (step S57) to rotate photosensitive drum 11 in the arrow a direction in FIG. 2, and rotate intermediate transfer belt 41 in the arrow b direction at the identical circumferential speeds. The charging process is executed (S58) simultaneously with the actuation of main motor M1, so as to uniformly charge the surface of photosensitive drum 11 to a predetermined potential via charging brush 13.

In sequence 2 (steps S61 through S63), a predetermined time after main motor M1 is actuated and photosensitive drum 11 is charged (time t13 in the timing chart), the developing bias process is executed (step S61).

In sequence 3 (steps S64 through S68), a predetermined time after the developing bias has been ON (time t14 in the timing chart), the primary transfer bias process is executed (S64). The residual toner image remaining on the surface of photosensitive drum 11 is transferred onto the intermediate transfer belt 41 via the application of the bias voltage to primary transfer roller 46 by the primary transfer voltage application means. As previously mentioned, the bias voltage applied to the primary transfer roller 46 is a voltage of the opposite polarity to the polarity of the toner charge. CPU 118 outputs a blade contact signal and a secondary transfer roller retraction signal to cam driving motor M3 at the same time the primary transfer bias is applied so as to rotate first cam 114 and second cam 115 to the position of angle of rotation of 90° shown in FIG. 5, and cause blade 51 to contact intermediate transfer belt 41, and cause secondary transfer roller 59 to retract from intermediate transfer belt 41 (S65). The count of timer 1 starts to time the end of cleaning of intermediate transfer belt 41 (S66). Timer 1 is set in CPU 118.

The timer value T1 set in timer 1 is determined as follows.

T1 (seconds)=(L1+α)/V where L1 is the distance (mm) of the circumference of the intermediate transfer belt, α is the margin (mm), and V is the system speed (mm/sec).

Thus, blade 51 is contacted with intermediate transfer belt 41 to remove the residual toner remaining on the surface of intermediate transfer belt 41 to clean said intermediate transfer belt 41.

When the count of timer 1 ends (time t15 in the timing chart) in sequence 4 (steps S69 through S74), CPU 118 executes the secondary transfer bias process (S70) to apply a bias voltage to secondary transfer roller 59 that is of a polarity that is opposite the polarity during printing via a secondary transfer voltage application means. This opposite polarity bias voltage is the opposite polarity to the polarity of the charged toner. In addition, CPU 118 outputs a secondary transfer roller contact signal to can driving motor M3 to rotate first cam 114 and second cam 115 to position of angle of rotation 180° shown in FIG. 3, and secondary transfer roller 59 is contacted with intermediate transfer belt 41 (S71). At the same time, timer 2 is set (S72). A value is set in timer 2 which adds the time until the toner on secondary transfer roller 59 returned from intermediate transfer belt 41 reaches blade 51 to the time required for secondary transfer roller 59 to complete one revolution.

The timer value T2 set in timer 2 is determined as follows.

T2 (seconds)=(L2+L3+α)/V where L2 is the distance (mm) of the circumference of the secondary transfer roller, L3 is the distance from the secondary roller position to the blade position (mm), α is the margin (mm),and V is the system speed (mm/sec).

L3 is shown in FIG. 4.

Thus, the residual toner remaining on secondary transfer roller 59 is returned to intermediate transfer belt 41 via the opposite bias of the secondary transfer, and the toner returned to intermediate transfer belt 41 is removed therefrom by blade 51 which is brought into contact with said belt 41, thereby cleaning secondary transfer roller 59.

The cleaning of secondary transfer roller 59 eliminates the toner image transferred to secondary transfer roller 59 during the paper jam, and eliminates the toner which falls from intermediate transfer belt 41 during the cleaning of said intermediate transfer belt 41. When cleaning of secondary transfer roller 59 is omitted, back side soiling occurs during the next printing.

In sequence 5 (steps S75 through S80), when the count of timer 2 ends (time t16 in the timing chart), CPU 118 terminates the secondary transfer opposite bias process (S76), and outputs a blade retraction signal and secondary transfer roller retraction signal to cam driving motor M3 to rotate first cam 114 and second cam 115 to the position of angle of rotation 0° shown in FIG. 4, so as to retract blade 51 and secondary transfer roller 59 from intermediate transfer belt 41 (S77, S78).

Then, each device that is ON is turned OFF. That is, in sequence 6 (S81 through S83), a predetermined time (time t17 in the timing chart) after blade 51 and secondary transfer roller 59 have been retracted, the developing bias process is terminated (S81). In sequence 7 (S84 through S86), a predetermined time (time t18 in the timing chart) after the developing bias process has been terminated, the primary transfer bias process is terminated (S84). In sequence 8 (S87 through S89), a predetermined time (time t19 in the timing chart) after the primary transfer bias has been terminated, the charging process is terminated (S87).

In sequence 9 (S90 through S92), a predetermined time (time t20 in the timing chart) after the charging process has been terminated, the polygonal mirror motor M2 is stopped and main motor M1 is stopped (S90, S91), and sequence 0 [zero] is set (S92), the cleaning operation ends for intermediate transfer belt 41 and secondary transfer roller 59.

Since the residual toner is reliably removed from intermediate transfer belt 41 and secondary transfer roller 59, soiling due to residual toner does not occur in print operations after a jam is cleared, thereby producing clean images.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

a photosensitive member which forms a toner image;

an endless transfer belt which transfers said toner image from said photosensitive member;

a driver which rotates said endless transfer belt;

a secondary transfer roller which is provided so as to be capable of being in contact with said endless transfer belt or retracting from said endless transfer belt, and which transfers said toner image from said endless transfer belt to a recording sheet fed between said endless transfer belt and said secondary transfer roller;

a secondary transfer roller holder which holds said secondary transfer roller in a state of contact with said endless transfer belt or in a state of retracting from said endless transfer belt;

a cleaner which is provided so as to capable of being in contact with said endless transfer belt or retracting from said endless transfer belt, and which removes residual toner from said endless transfer belt in accordance with a rotation of said endless transfer belt when in a state of contact with said endless transfer belt;

a cleaner holder which holds said cleaner in a state of contact with said endless transfer belt or in a state of retracting from said endless transfer belt;

a voltage application means for applying a voltage between said endless transfer belt and said secondary transfer roller so as to return residual toner remaining on said secondary transfer roller to said endless transfer belt; and a controller which controls said driver, said secondary transfer roller holder, said cleaner holder and said voltage application means in order to remove said residual toner on said endless transfer belt, so that said endless transfer belt rotates in a state that said cleaner is contacted with said endless transfer belt and said secondary transfer roller is retracted from said endless transfer belt without applying said voltage by said voltage application means, and after one or more rotations of said endless transfer belt, said endless transfer belt continues to rotate in a state that said cleaner and said secondary transfer roller are contacted with said endless transfer belt with applying said voltage by said voltage application means.

2. The image forming apparatus as claimed in claim 1, wherein said secondary transfer roller rotates one or more rotations and said voltage is applied by said voltage application means after one or more rotations of said endless transfer member.

3. The image forming apparatus as claimed in claim 1, further comprising:

a jam detector which detects a paper jam in a recording sheet feed path.

4. The image forming apparatus as claimed in claim 3, further comprising:

a jam removal detector which detects an elimination of said paper jam.

5. The image forming apparatus as claimed in claim 4, wherein said controller operates after said jam removal detector detects the elimination of said paper jam.

6. The image forming apparatus as claimed in claim 1, further comprising:

an instruction means for instructing a start of a printing operation.

7. The image forming apparatus as claimed in claim 6, wherein said controller operates after said instruction means instructs the start of said printing operation.

8. An image forming apparatus comprising:

a photosensitive member which forms a toner image;

an intermediate transfer member which transfers said toner image from said photosensitive member in accordance with a rotation of said intermediate transfer member;

a secondary transfer member which is provided so as to be capable of being in contact or non-contact with said intermediate transfer member, and which transfers said toner image on said intermediate transfer member to a recording sheet in a state of contact with said intermediate transfer member;

a cleaner which removes residual toner from said intermediate transfer member in accordance with the rotation of said intermediate transfer member in a state of contact with said intermediate transfer member;

a voltage application means for applying a voltage between said intermediate transfer member and said secondary transfer member so as to return residual toner remaining on said secondary transfer member to said intermediate transfer member; and a controller which operates said intermediate transfer member, said secondary transfer member and said voltage application means in order to remove said residual toner on said intermediate transfer member by said cleaner, so that said intermediate transfer member rotates in a state that said secondary transfer member is non-contacted with said intermediate transfer member without applying said voltage by said voltage application means, and after one or more rotations of said intermediate transfer member, said intermediate transfer member continues to rotate in a state that said secondary transfer member is contacted with said intermediate transfer member with applying said voltage by said voltage application means.

9. The image forming apparatus as claimed in claim 8, further comprising:

a jam detector which detects a paper jam in a recording sheet feed path.

10. The image forming apparatus as claimed in claim 9, further comprising:

a jam removal detector which detects the elimination of said paper jam.

11. The image forming apparatus as claimed in claim 10, wherein said controller operates after said jam removal detector detects the elimination of said paper jam.

12. The image forming apparatus as claimed in claim 8, wherein said secondary transfer member is a secondary transfer roller, and said controller controls said secondary transfer roller so as to rotate one or more rotations and said voltage is applied by said voltage application means after one or more rotations of said intermediate transfer member.

13. The image forming apparatus as claimed in claim 12, wherein said secondary transfer roller transfers said toner image on said intermediate transfer member to said recording sheet fed between said intermediate transfer member and said secondary transfer roller.

14. The image forming apparatus as claimed in claim 8, further comprising:

an instruction means for instructing a start of a printing operation.

15. The image forming apparatus as claimed in claim 14, wherein said controller operates after said instruction means instructs the start of said printing operation.

16. The image forming apparatus as claimed in claim 8, wherein a polarity of said voltage applied between said intermediate transfer member and said secondary transfer member is opposite to a polarity of said toner.

17. The image forming apparatus as claimed in claim 8, wherein said intermediate transfer member is an endless belt.

18. The image forming apparatus as claimed in claim 8, wherein said cleaner is provided so as to be capable of contact or non-contact with said intermediate transfer member.

* * * * *

UNITED STATES PATENT AND TRADEMARK OFFICE

CERTIFICATE OF CORRECTION

PATENT NO. : 5,822,648

DATED : October 13, 1998

INVENTOR(S) : Mohri

It is certified that error appears in the above-identified patent and that said Letters Patent is hereby corrected as shown below:

On the title page, Item [54], and Column 1,

In the Title:

Please delete "TRANSFER DEVICE CLEANING SEQUENCE FOR AN IMAGE" and insert "CLEANING SEQUENCE FOR AN IMAGE TRANSFER DEVICE".

Signed and Sealed this

Twenty-ninth Day of June, 1999

*Attest:*

Q. TODD DICKINSON

*Attesting Officer*

*Acting Commissioner of Patents and Trademarks*